United States Patent [19]

Smith

[11] 4,170,456

[45] Oct. 9, 1979

[54] INHIBITING SPONTANEOUS COMBUSTION OF COAL CHAR

[75] Inventor: Robert H. Smith, Plano, Tex.

[73] Assignee: Atlantic Richfield Company, Los Angeles, Calif.

[21] Appl. No.: 962,816

[22] Filed: Nov. 22, 1978

[51] Int. Cl.[2] ..... C10L 9/00; C09C 1/56

[52] U.S. Cl. ..... 44/1 F; 423/460

[58] Field of Search ..... 44/1 F, 1 R, 10 C, 6; 423/449, 460; 201/41; 427/215

[56] References Cited

U.S. PATENT DOCUMENTS

| | | | |
|---|---|---|---|
| 3,754,876 | 8/1973 | Pennington et al. | 44/1 F |
| 3,817,874 | 6/1974 | Wennerberg et al. | 423/460 X |
| 3,985,517 | 10/1976 | Johnson | 44/1 R |
| 4,053,285 | 10/1977 | Robinson et al. | 44/1 F |

*Primary Examiner*—Carl Dees

*Attorney, Agent, or Firm*—Ronnie D. Wilson

[57] ABSTRACT

A method of inhibiting the spontaneous combustion of coal char which comprises treating coal char with air following by carbon dioxide to deactivate the surface of the coal char to oxygen.

6 Claims, No Drawings

INHIBITING SPONTANEOUS COMBUSTION OF COAL CHAR

Coal char, the solid product from carbonization of coal, reacts readily with oxygen and thus is susceptible to spontaneous combustion upon exposure thereto. The susceptibility of coal char to spontaneous combustion is effected by various factors such as moisture content, particle size, temperature and oxidation rate, the most important of which is oxidation rate.

Spontaneous combustion occurs via the oxidation of coal char from the air. Spontaneous combustion occurs when the rate of heat generation from oxidation exceeds the rate of heat dissipation. Previous workers have found that the reason spontaneous combustion does not occur more often than it does is that the oxidation rate of coal char decreases with the increasing time of or extent of oxidation. Therefore, when coal char is exposed to oxygen, a race begins between the effects of high temperature coefficient of oxidation rate and the decreasing rate of oxidation as oxygen is consumed by the coal char. Depending on the winner, spontaneous combustion occurs or doesn't occur.

Generally, coal char is produced to effect a higher heating value product from low rank coals. The economics of such upgrading depend on being able to handle coal char in the same manner as coal. Thus, coal char must be deactivated to reduce the potential for spontaneous combustion.

I have found an efficient and economical way of greatly inhibiting the possibility of spontaneous combustion of coal char. My method for inhibiting spontaneous combustion of coal char comprises treating coal with air followed by carbon dioxide. Treatment of coal char with air and carbon dioxide significantly reduces the spontaneous heating rate of coal char over that effected by either air alone or carbon dioxide alone.

The present invention can be applied to coal char of any size but has a greater value with coal char of smaller sizes due to the greater surface area subjected to oxidation.

To carry out the method of the present invention, the coal char is exposed to air at a temperature of from about 100° F. to about 500° F. and subsequently, pure carbon dioxide or a carbon dioxide containing gas such as flue gas is contacted at a temperature of from about 50° F. to about 300° F. with the coal char. Preferably, a temperature of from about 100° F. to about 200° F. is utilized for the carbon dioxide treatment. Since the adsorption of carbon dioxide on the coal char is very rapid, a very short residence time is required to deactivate the surface of the coal char.

The treatment of the present invention may be carried out by conventional techniques utilizing a fluid bed treater or the gases may be introduced at the base of a pile of char.

After treatment, the coal char can be handled, transported and/or stored without fear of spontaneous combustion.

In order to more fully illustrate the invention, the following example is given to demonstrate the effectiveness of the present invention by showing the reduction in spontaneous heating rate.

Coal char used in the experimental runs was produced from Wyoming coal in a batch carbonizer at 1000° F. maximum temperature. The coal char was covered with nitrogen during storage and then was transferred from storage to a one liter Dewar flask (for the spontaneous heating runs) or treatment reactors (for the treatment runs) using a glove box purged with nitrogen.

For the treatment portion of the experiment, reactors of one inch diameter and 15 inches in length were utilized. The reactors were immersed in a constant temperature bath maintained at 200° F. for the oxidation treatment and 120° F. for the carbon dioxide treatment. The carbon dioxide gas contained 25 percent $CO_2$ by volume with the remainder nitrogen.

The spontaneous heating portion of the experiment utilized a setup consisting of a one liter Dewar flask fitted with a stopper. Air was metered through a rotometer and then fed into the bottom of the flask through a fritted glass sparger. Air flowed upward through a 9-inch deep bed of coal char (250 gm.) which was supported on a wire mesh screen in the bottom of the flask. Thermocouples were located three and six inches from the top of the char bed. Temperatures were recorded on a dual pen recorder. The exhaust gas was sent to an oxygen analyzer and then to a wet test meter.

The spontaneous heating portion of the experiment was started with coal char at room temperature (75°-76° F.) and purged with nitrogen. Air flow was started at a rate of 60 cc/minute into the char bed. The temperature began to rise almost immediately after air was introduced into the char bed. The temperature at the lower thermocouple increased more rapidly. With untreated coal char, the temperature in the upper portion of the bed lagged behind the lower portion by 89° F. at the end of the run. The upper temperature was still increasing at the end of the 6.5 hour run. Spontaneous combustion could have been achieved, because the rate of temperature increase was nearly constant and oxygen content of the exit gas was still less than one percent at the end of the run. The run was discontinued to prevent overheating of the Dewar flask.

The spontaneous heating rates of the chars treated by the method of the present invention were reduced significantly from that of the untreated chars. For these particular set of runs, the best conditions of the present invention were air treatment for 30 minutes at 200° F. followed by $CO_2$ treatment at 120° F. for 30 minutes. This treatment produced a greater reduction in spontaneous heating rates than air treatment alone as well as carbon dioxide treatment alone.

Thus, from the foregoing, it is clear that the method of the present invention provides a way to inhibit spontaneous combustion of coal char during storage, handling or transporting.

Therefore, I claim:

1. A method for inhibiting spontaneous combustion of coal char which comprises treating said char with air followed by carbon dioxide.

2. The method of claim 1 wherein said air treatment takes place at a temperature of from about 100° F. to about 500° F.

3. The method of claim 1 wherein said $CO_2$ treatment takes place at a temperature of from about 50° F. to about 300° F.

4. The method of claim 3 wherein said $CO_2$ treatment takes place at a temperature of from about 100° F. to about 200° F.

5. The method of claim 1 wherein said carbon dioxide is present in a flue gas.

6. The method of claim 1 wherein said air treatment and said $CO_2$ treatment takes place at a temperature of 200° F. and 120° F., respectively.

* * * * *